United States Patent [19]

Servay

[11] Patent Number: 4,665,591

[45] Date of Patent: May 19, 1987

[54] BUCKLE CONSTRUCTION HAVING DECORATIVE MATERIAL RETENTION MEANS

[75] Inventor: Willy Servay, Montreal, Canada

[73] Assignee: Century Products, Ltd., Quebec, Canada

[21] Appl. No.: 835,731

[22] Filed: Mar. 3, 1986

[30] Foreign Application Priority Data

Nov. 22, 1985 [CA] Canada ..... 496046

[51] Int. Cl.[4] ..... A44B 11/00

[52] U.S. Cl. ..... 24/163 K; 24/113 MP; 24/163 FC

[58] Field of Search ..... 24/163 K, 163 R, 163 FC, 24/90 A, 92, 103, 113 R, 113 MP

[56] References Cited

U.S. PATENT DOCUMENTS

| | | | |
|---|---|---|---|
| 336,062 | 2/1886 | Palmer | 24/113 MP |
| 395,186 | 12/1888 | Smith | 24/113 R |
| 516,787 | 3/1894 | Cooke | 24/113 R |
| 1,854,689 | 4/1932 | Carter | 24/113 R |
| 2,046,807 | 7/1936 | Becker et al. | 24/163 FC |
| 2,065,202 | 12/1936 | Weidhorn | 24/163 FC |
| 2,214,030 | 9/1940 | Pereles | 24/113 MP |
| 2,654,927 | 10/1953 | Tansman | 24/113 R |
| 2,912,737 | 11/1959 | Dritz | 24/163 FC |
| 3,237,262 | 3/1966 | Decker | 24/163 FC |
| 4,534,088 | 8/1985 | Ricke | 24/113 MP |

FOREIGN PATENT DOCUMENTS

| | | | |
|---|---|---|---|
| 555191 | 3/1957 | Belgium | 24/113 R |
| 1168719 | 10/1969 | United Kingdom | 24/163 FC |

*Primary Examiner*—Victor N. Sakran

*Attorney, Agent, or Firm*—Oblon, Fisher, Spivak, McClelland & Maier

[57] ABSTRACT

A buckle comprising a decorative outer frame having a circumferential top wall and opposed depending side walls extending rearwardly of the top wall. A channel is defined between the depending side walls under the top wall. A casted back member is provided with a projection portion which is configured to be received in the channel. The outer frame is retained on the casted back member by bending the outer one of the side walls under the projection portion which is received at least in part in the channel. The casted back may have a variety of designs and attachments all formed in a single casting.

12 Claims, 6 Drawing Figures

BUCKLE CONSTRUCTION HAVING DECORATIVE MATERIAL RETENTION MEANS

BACKGROUND OF INVENTION (a) Field of Invention

The present invention relates to an improved buckle construction having multiple uses and comprised of a decorative outer frame which is clamped on a projection portion of a back member or casted back member. The outer frame may be covered by a material or may be polished to form an ornamental surface.

(b) Description of Prior Art

Numerous buckle constructions for attachment to pant belts shoes, purses, etc., are known.

Buckles heretofore known are constructed with a ring-shaped outer support frame, having specific configuration, and secured on a base or back member of like configuration. Other attachment parts are then secured to the support frame of base to form a complete buckle and decorate same. This makes a buckle structure with many parts which are subject to become undone or break. Also, the buckle is expensive to fabricate due to its many parts and labor. The buckle further has limitations when it comes to decoration thereof.

It is customary with the fashion industry to provide buckles covered with a decorative fabric. This is achieved by providing a ring shaped support frame and base of like configuration and U-shape cross-section and engaging the base within the U-shaped support frame to clasp a fabric over the support frame. The construction of such buckles have limited uses and decorative designs.

SUMMARY OF INVENTION

It is a feature of the present invention to provide an improved buckle of the above-mentioned types and having an improved back member.

It is a further feature of the present invention to provide a buckle having a ring-shaped decorative frame and a casted back.

Another feature of the present invention is to provide a buckle having a casted back which may have a variety of configurations and which may provide the connecting parts of the buckle as well as ornamentation.

Another feature of the present invention is to provide an improved buckle construction having a ring-shaped support frame covered with a decorative material and wherein an ornament may be formed or supported centrally of the ring-shaped outer frame and formed integral as a casting with the casted back.

According to the above features, from a broad aspect, the present invention provides a buckle comprising a decorative outer frame having a circumferential top wall and opposed depending side walls extending downwardly of the top wall. A channel is defined between the depending side walls under the top wall. A metal casted back member is also provided and having a projection portion which is configured to be received in the channel. Retention means is provided to retain the outer frame on the projection portion with the projection portion received, at least in part, in the channel. The back member also has an integrally casted decorative metal part spaced from the projection portion and visible from the same side as the decorative outer frame top wall.

It is pointed out that by having a two-piece buckle with a casted back, that a variety of buckle designs and types can be made regardless of the shape of the outer buckle frame. For example only, the casted back may have belt attachments formed integral therewith or any ornament design casted thereon. The buckle could be formed as any ornament piece with the casted back providing the background and securement means all casted in one mould. This has not heretofore been done in the prior art.

BRIEF DESCRIPTION OF DRAWINGS

A preferred embodiment of the present invention will now be described with reference to the examples thereof as illustrated in the accompanying drawings, in which.

DESCRIPTION OF PREFERRED EMBODIMENTS

Figure 1:
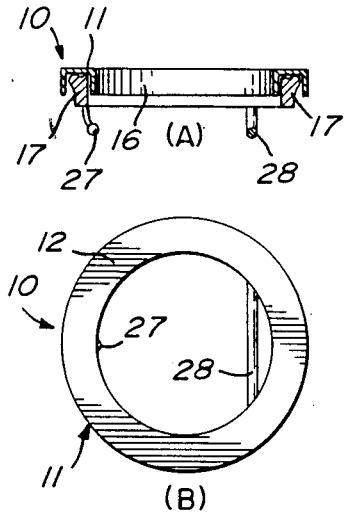
FIGS 1A and 1B are side and plan section views respectively of a buckle constructed according to an example of the present invention showing the belt attachments casted integral with the back member.
Figure 2:
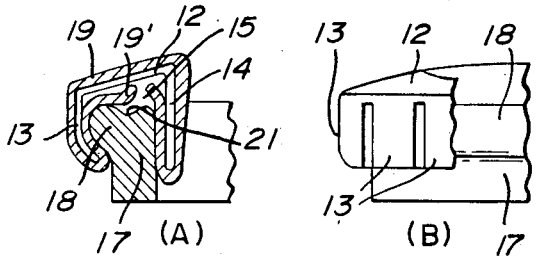
FIGS 2A and 2B are fragmented transverse section views of a buckle construction in accordance with an example of the present invention.

Referring to the drawings, and more particularly to FIGS. 1 and 2, there is generally at 10 a buckle constructed in accordance with the present invention. The buckle comprises essentially a ring-shaped decorative outer frame 11 having a circumferential top wall 12 and opposed depending side walls, herein outer side wall 13 and inner side wall 14 which extend rearwardly of the top wall 12 in a common direction. A channel 15 is defined between the depending side walls 13 and 14 under the top wall 12. As shown in FIG. 1B the outer frame 11 is of an annular or ring-shaped configuration.

A back member 16 is provided as a unitary casting for connection with the outer frame 11 and, as herein shown, is also of annular or ring-shaped configuration. The casted back member 16 is better illustrated in FIG. 2A and as shown is shaped with a projection portion 17 which is configured to be received within the channel 15 of the outer frame. The projection portion 17 is provided with an outwardly projecting clamping ridge 18 adjacent a top end 19 thereof. The purpose of the clamping ridge 18 is to permit the outer side wall 13 of the outer frame 11 to be clamped under the ridge. A decorative fabric 19 may also be retained captive and taut over the outer frame 11 overlying both the top wall 12 and side walls 13 and 14 thereof and extending into the cavity 15 under the top wall 12. Thus, the outer side wall 13 of the outer wall constitutes a retention means which retains the outer frame on the back member with the projection portion 17 having at least an uppermost part thereof received and retained within the channel 15. The decorative material 19 is clamped between the depending side walls 13 and 14 and the projection portion with an end portion 20 of the material 19 extending within the cavity 15. In order to ensure that there is ample space within the cavity, the top wall 11 may be sloped outwardly from the outer side wall 13. Further, a channel 21 is formed in the top end of the projection portion 17.

The casted back member 16 is herein shown casted with the usual pant belt attachments 27 and 28 to secure a belt about a wearer's waist in a manner well known in the art.

As shown in FIG. 2B, the outer side wall 13 may be constituted by a plurality of closely spaced finger-like wall projections 13' whereby to facilitate bending or clamping the outer side wall under the clamping ridge 18. However, by making this outer frame from thin aluminum sheeting, the outer side wall 13 can be deformed easily to clamp under the ridge. The outer side wall may be a solid side wall with the outer frame being ring-shaped as shown in FIG. 1B, and receiving in its cavity a further ring-shaped back member.

Figure 3:
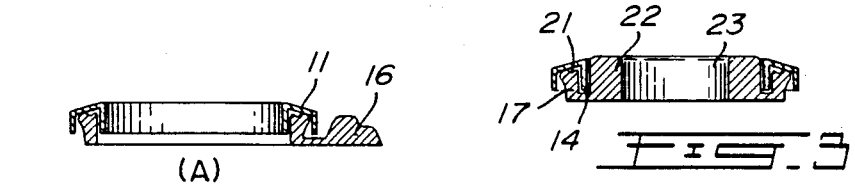
FIG. 3 is a side cross-section view of another example of a buckle constructed in accordance with the present invention.
Figure 4:
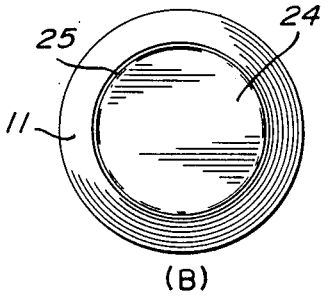
FIGS. 4A and 4B are a side cross-section view and a plan view respectively of a modification of the buckle of FIG. 3 where the back member has a casted ornamental center portion.

As shown in FIG. 3, the back member is provided as a different shaped casting having an ornamental wall portion 22 intermediate the ring-shaped projection portion 17. The ornamental wall is formed to project in the hollow portion circumscribed by the inner side wall 14 of the outer frame 11. As herein shown, the ornamental wall 22 is formed with a cavity 23 at the center thereof and the cavity may have different shapes to simulate various designs. In FIG. 4, the ornamental wall 22 is a solid wall 23 and may have a design casted in the top face 24 thereof or may be simply a metal member having a shiny finish on the outer wall 24 or have an ornament, such as a stone glued or otherwise secured thereto. In both examples, the back member is provided as a solid metal casting with a peripheral slot or groove formed inwardly spaced from the outer peripheral edge thereof, with the outer edge portion forming the projection portion 17 of the back member. The inner side wall 14 of the outer frame 11 is received within this peripheral slot 25 with the top wall 12 of the outer frame 11 being aligned substantially in the same plane as the top wall 24 of the ornamental portion of the casted back member 16.

Figure 5:
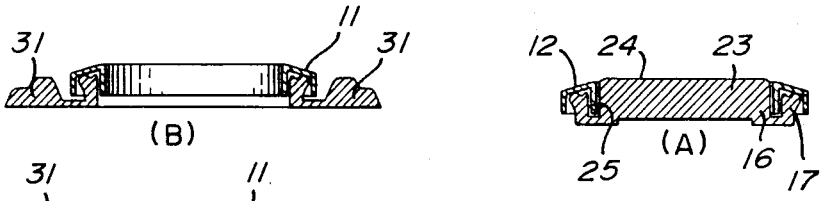
FIGS. 5A, 5B and 5C are two side cross-section views and a plan view of further examples of a buckle construction of the present invention showing various designs of the casted back.
Figure 5:
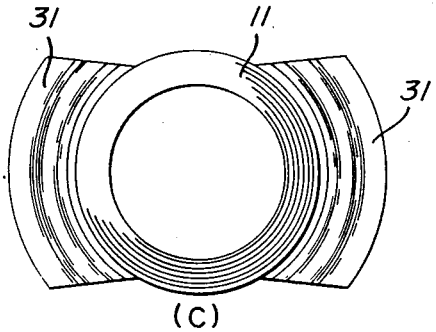
Figure 6:
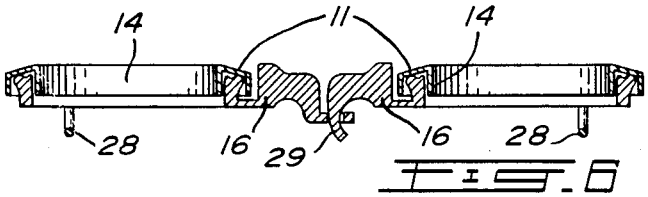
FIG. 6 is a side section view illustrating a still further example of a buckle constructed in accordance with the present invention.

FIGS. 5 and 6 show other examples of a buckle constructed in accordance with the present invention. As shown in FIG. 6, the casted back member 16 is for use as a belt buckle and is provided with the usual belt attachment means 28 and 29 whereby to secure a belt (not shown) about a wearer's waist in a manner well known in the art. These attachment means comprise two loop rings 28 and a mating connector 29 formed integral with the castings or back members 16. FIGS. 5A to 5C show two other examples of a back member 16 having a different ornamental configuration wherein the ornamental wall is provided as an outer side portion 31 casted to both sides of the outer frame.

In summary, the novel buckle construction of the present invention consists of a ring-shaped channel-like outer decorative frame 11 which defines an inner channel to receive therein a projection portion 17 of a casted back member 16. The casted back may have a variety of designs extending out of the outer frame 11 or have belt attachment means, all of which are obtained in a single casting.

The projection portion 17 may have a channel 21 formed in a top wall thereof whereby a decorative material overlying the top wall 12 and depending opposed side walls 13 and 14 of the outer frame 11 and turned inwardly of the side walls may be rigidly clamped between the inside faces of the side walls and the projection portion 17 of the casted back 16. As the channel member is pressed over the projection portion 17, the material is made taut about the ring-shaped support frame and free end portions of this decorative material are received within the cavity 15 under the top wall of the outer frame. The projection portion of the back member is provided with a clamping ridge 18 whereby the outer side wall of the support frame may be bent thereunder to constitute retention means to retain the support frame on the back member. Of course, the clamping ridge 18 may face the inside wall 14 and the inside wall may be bent under the projection. Although the outer frame as herein shown has an annular or ring-shaped support frame, it may be course have a different configuration such as square, rectangular, oval, etc. The casted back may also have various configurations regardless of the configuration of the outer frame 11, as illustrated in the drawings.

It is within the ambit of the present invention to cover any other obvious modificatins of the examples of the preferred embodiment described and shown herein provided such modifications fall within the scope of the appended claims.

I claim:

1. A buckle comprising a decorative outer frame having a circumferential top wall and opposed depending side walls extending downwardly of said top wall, a channel defined between said depending side walls under said top wall, a metal casted back member having a projection portion which is configured to be received in said channel; retention means to retain said outer frame on said projection portion with said projection portion received, at least in part, in said channel; said back member having an integrally casted decorative metal part spaced from said projection portion and visible from the same side as said decorative outer frame top wall.

2. A buckle as claimed in claim 1 wherein there is further provided cavity means intermediate said channel and said projection portion for reception of an end portion of a decorative material overlying said top wall and depending side walls and clamped in said channel between said depending side walls and said projection portion.

3. A buckle as claimed in claim 2 wherein said projection portion is provided with a clamping ridge adjacent a top end thereof and coacting with said retention means for retention of said outer frame on said projection portion of said back member.

4. A buckle as claimed in claim 3 wherein said cavity means is a channel formed in said top end of said projection portion.

5. A buckle as claimed in claim 3 wherein said retention means is constituted by one of said side walls being bent back toward said projection portion under said clamping ridge.

6. A buckle as claimed in claim 1 or 5 wherein said walls are constituted by a plurality of closely spaced finger-like wall projections.

7. A buckle as claimed in claim 1 or 5 wherein said side walls are solid side walls made of a bendable metal such as aluminum.

8. A buckle as claimed in claim 1 wherein said decorative outer frame defines a closed loop, said channel being disposed peripherally of said loop, said casted back member projection portion being a ring having a shape corresponding to said closed loop, said casted decorative metal part being a casted ornamental wall intermediate said ring projection portion and which is visible through said closed loop.

9. A buckle as claimed in claim 5 wherein said casted decorative metal part is a casted belt attachment means extending outwardly of said back member for securement adjacent an end of a pant belt and for selective securement adjacent on opposite end of said belt when position about a wearer.

10. A buckle as claimed in claim 5 wherein said casted back member has a peripheral slot disposed inwardly spaced from a peripheral outer edge thereof, said projection portion being formed integral with said casted back member intermediate said peripheral slot and outer edge, said top wall of said outer frame being disposed below a top plane of said metal member when said outer frame is secured to said projection portion.

11. A buckle as claimed in claim 10 wherein said casted back member is a disc member, said outer frame being ring-shaped and secured about said projection portion.

12. A buckle as claimed in claim 11 wherein said disc member has a through bore disposed centrally thereof.

* * * * *